US008932090B2

(12) United States Patent
Jaeckle et al.

(10) Patent No.: US 8,932,090 B2
(45) Date of Patent: Jan. 13, 2015

(54) ELECTRICAL CONNECTION HAVING PRESS-FITTED PARTNERS WITH AN OSP COATING

(75) Inventors: Philippe Jaeckle, Gerlingen (DE); Stefan Rysy, Stuttgart (DE); Michael Krapp, Reutlingen (DE); Svetislav Vukovic, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 101 days.

(21) Appl. No.: 13/502,795

(22) PCT Filed: Oct. 4, 2010

(86) PCT No.: PCT/EP2010/064726

§ 371 (c)(1),
(2), (4) Date: Jul. 9, 2012

(87) PCT Pub. No.: WO2011/047953

PCT Pub. Date: Apr. 28, 2011

(65) Prior Publication Data

US 2012/0270432 A1 Oct. 25, 2012

(30) Foreign Application Priority Data

Oct. 19, 2009 (DE) ..... 10 2009 045 806
Nov. 24, 2009 (DE) ..... 10 2009 047 043

(51) Int. Cl.
*H01R 9/24* (2006.01)
*H01R 4/58* (2006.01)
*H01R 4/26* (2006.01)

(52) U.S. Cl.
CPC ... *H01R 4/58* (2013.01); *H01R 4/26* (2013.01)
USPC ..... 439/866

(58) Field of Classification Search
None
See application file for complete search history.

(56) References Cited

U.S. PATENT DOCUMENTS 3,783,433 A * 1/1974 Kurtz et al. ..... 439/82
4,116,522 A * 9/1978 Reynolds ..... 439/398
4,220,390 A * 9/1980 Cobaugh et al. ..... 439/401
4,381,134 A * 4/1983 Anselmo et al. ..... 439/444
4,526,429 A * 7/1985 Kirkman ..... 439/82
4,967,316 A * 10/1990 Goebel et al. ..... 361/816

(Continued)

FOREIGN PATENT DOCUMENTS

CN 2308972 2/1999
DE 102005062601 7/2007

(Continued)

OTHER PUBLICATIONS

PCT/EP2010/064726 International Search Report dated Jan. 18, 2011 (Translation and Original, 4 pages).

*Primary Examiner* — Chandrika Prasad
(74) *Attorney, Agent, or Firm* — Michael Best & Friedrich LLP

(57) ABSTRACT

The invention relates to a solderless electrical connection (42) between a first joining partner (10, 46) and a second joining partner (24, 26; 44) for connecting an electrical component, a connector strip or a lead frame. According to the invention, the first joining partner (10, 46) or both joining partners (10, 46, 24, 26, 44) have an OSP coating (56) on their respective contact surfaces (14, 48, 54, 34, 50).

20 Claims, 2 Drawing Sheets

(56) References Cited

U.S. PATENT DOCUMENTS

| | | | | |
|---|---|---|---|---|
| 5,498,301 | A | 3/1996 | Hirao et al. | |
| 5,560,785 | A | 10/1996 | Hirao et al. | |
| 6,206,735 | B1 * | 3/2001 | Zanolli | 439/736 |
| 7,097,462 | B2 * | 8/2006 | Ichikawa | 439/66 |
| 7,361,031 | B2 * | 4/2008 | Matsumura | 439/82 |
| 2006/0061722 | A1 * | 3/2006 | Jun | 349/139 |
| 2008/0173470 | A1 * | 7/2008 | Barbetta et al. | 174/257 |
| 2008/0268267 | A1 * | 10/2008 | Barbetta et al. | 428/458 |
| 2009/0239398 | A1 * | 9/2009 | Lynch et al. | 439/81 |

FOREIGN PATENT DOCUMENTS

| | | |
|---|---|---|
| JP | S4973691 | 7/1974 |
| JP | S58501281 | 8/1983 |
| JP | 4280697 | 10/1992 |
| JP | H06322551 | 11/1994 |
| JP | H07243053 | 9/1995 |
| JP | 2009016064 | 1/2009 |
| WO | 0223677 | 3/2002 |
| WO | 2006082248 | 8/2006 |
| WO | 2009005042 | 1/2009 |

* cited by examiner

ELECTRICAL CONNECTION HAVING PRESS-FITTED PARTNERS WITH AN OSP COATING

BACKGROUND OF THE INVENTION

DE 10 2005 005 127 A1 discloses an electrical contact and a process for the production thereof. Said document describes an electrical contact for the cold contact-making technique, comprising a metallic substrate which is provided with a coating. The coating is formed from a dispersion of particles of carbon and/or a polymer in a metal. According to this solution, the electrical contact is preferably in the form of a plug contact. The cold contact-making technique involves the two joining partners being pressed together, which can also assume the form of an insulation displacement connection or is provided by a press-fitting technique. Thus, by way of example, a pin is inserted into a terminal or a sleeve which has a coating in which chip formation can occur. According to DE 10 2005 005 127 A1, either one joining partner or both joining partners can be provided with a coating.

DE 10 2005 062 601 A1 relates to an electrical appliance with a lubricated joint and also to a process for lubricating such a joint. According to this solution, an electrical appliance, in particular a control unit, is provided at at least one joint with a first joining partner, in particular a sleeve, which interacts with a second joining partner, in particular a pin. The joint comprises a seam between the two partners to be joined, in which seam an at least partially solidified lubricant is present. The lubricant may be a multi-component substance, wherein the hardened lubricant at least partially outwardly seals the joint at a, preferably axial, end of the joint.

The solidified lubricant bonds at least one metallic chip.

A substance called "Glicoat SMD F2 (LX)" is known from Glicoat SMD Organic Solderability Preservatives (OSP) www.electrochemicals.com), and is used for coating electrical contact elements and printed circuit boards, cf. U.S. Pat. No. 5,498,301 and U.S. Pat. No. 5,560,785. Appropriate OSP coatings, e.g. on the basis of phenylimidazoles or benzimidazoles, are also known from other manufacturers, e.g. Enthone.

In the press-fitting technique, a solderless electrical connection is produced between the connecting pin of a plug strip of another component and a metalized hole in a printed circuit board (sleeve). The connecting pin has a solid or elastic press-fitting zone, the geometry of which is generally manufacturer-specific. Said press-fitting zone undergoes plastic and elastic deformation as it is pressed into the printed circuit board sleeve, and adapts to the diameter of the sleeve. The pin is thereby directly contact-connected with the sleeve.

The printed circuit board sleeve consists essentially of copper, with an overlying further coating as a surface for preventing copper oxidation. Said further coating may be a hot tin plating or a chemically deposited metallization, for example nickel or gold or nickel/gold or tin or silver. In addition, the further coating can be an organic passivation layer, a so-called OSP (organic surface passivation) "material". The press-fitting zone of the connecting pin usually consists of a copper base material and is usually metalized by electrodeposition. If said electrodeposited metallization is produced from tin, there is a risk that so-called tin whiskers may form. These are acicular tin single crystals having a diameter of a few μm and a length of up to several μm. As a result of these conductive whiskers, there is a risk of a short circuit between open contacts which lie closely together on the printed circuit board or between the connecting pins. If said electrodeposited metallization of the connecting pins is produced from other, for example harder, surfaces, such as nickel or gold or silver, there is a risk that inadmissible damage may occur to the printed circuit board as the connecting pins are being pressed in.

In the case of the insulation displacement technique, which is used as an alternative to the press-fitting technique, a solderless electrical connection is likewise produced between, for example, the wire of a component or of a lead frame and a metalized insulation displacement terminal. The insulation displacement terminal has a solid or elastic V-shaped notch, the geometry of which is generally manufacturer-specific. Said insulation displacement terminal and the wire undergo plastic and elastic deformation as the wire is pressed into the V-shaped notch of the insulation displacement terminal, and adapt to one another in terms of their contour. The wire is thereby directly contact-connected with the insulation displacement terminal.

The wire usually consists of copper or copper alloys or steel, with an overlying further coating as a surface for preventing oxidation. By way of example, said further coating for preventing oxidation may be an electrodeposited metallization, for example copper and tin or copper/nickel and tin. Within the insulation displacement technique, the insulation displacement terminal usually consists of a copper base material and, if appropriate, can be metalized by electrodeposition.

If one of the two surfaces is produced from tin, there is a risk that so-called tin whiskers may form. These are acicular tin single crystals having a diameter of a few μm and a length of up to several mm. As a result of these conductive whiskers, there is a risk of a short circuit between open contacts which lie closely together. If the electrodeposited metallization is produced from another, for example harder, material, for example nickel, gold or silver, there is a risk that no gas-tight connections will be produced when the insulation displacement technique is used. If the surface of the insulation displacement terminal is produced from bare copper or one of the alloys thereof, there is a risk of "fretting", i.e. the wire merges with the insulation displacement terminal much too early and does not reach the desired position, as a result of which the connection is considerably impaired.

SUMMARY OF THE INVENTION

According to the solution proposed according to the invention, the risk of tin whiskers arising is minimized when the press-fitting technique is used by applying an OSP layer to a relatively large region of the connecting pin, and is avoided completely in the case of an OSP-coated printed circuit board. The solution proposed according to the invention avoids the formation of tin chips, and first tests show a constant press-fitting force, with press-fitting forces which are lower than in the case of tin-plated or nickel-plated connecting pins. As a result, the damage to the metallization of the holes in a printed circuit board is minimized.

If, by contrast, the insulation displacement technique is used to produce a solderless electrical connection, the risk of tin whiskers and chips arising can be minimized by applying an OSP layer to one of the joining partners, for example either to the insulation displacement terminal or to the wire, or else to both joining partners, or can be avoided completely in the case of surfaces with an OSP coating on both sides. In addition, it is possible to achieve more gentle insulation displacement without inadmissible damage.

In some applications, the connecting pins are merely electroplated with nickel. In order to thereby achieve still sufficiently low press-fitting forces and a press-fitting connection which protects the sleeves, in many cases a lubricant is applied immediately before the press-fitting. In many other applications, too, a lubricant is used before the insulation displacement or before the press-fitting when the press-fitting technique or the insulation displacement technique is used to produce a solderless electrical connection. In the case of the solution proposed according to the invention, this process step can be dispensed with entirely. Instead, in the case of the press-fitting technique, the connecting pin is already coated with the OSP coating by the manufacturer, and said coating is used as a lubricant for the press-fitting process; this is also the case when the insulation displacement technique is used.

In both techniques, thus in the press-fitting technique and in the insulation displacement technique, it is possible to achieve a reduction in costs by virtue of a more cost-effective electroless surface coating instead of one or more coatings applied by electrodeposition and by virtue of the elimination of the process step for additionally applying a lubricant.

BRIEF DESCRIPTION OF THE DRAWINGS

The invention will be described in more detail hereinbelow on the basis of the drawing, in which.

DETAILED DESCRIPTION

In the text which follows, the expression "OSP coating" is understood to mean an organic passivation layer (organic solderability preservative) as is used conventionally in printed circuit board technology. The OSP coating is in particular a selectively acting Cu coordination compound such as, for example, phenylimidazole, benzimidazole, aminothiols, acetates, polyalcohols or diketones and further substances, to name examples.

Figure 1:
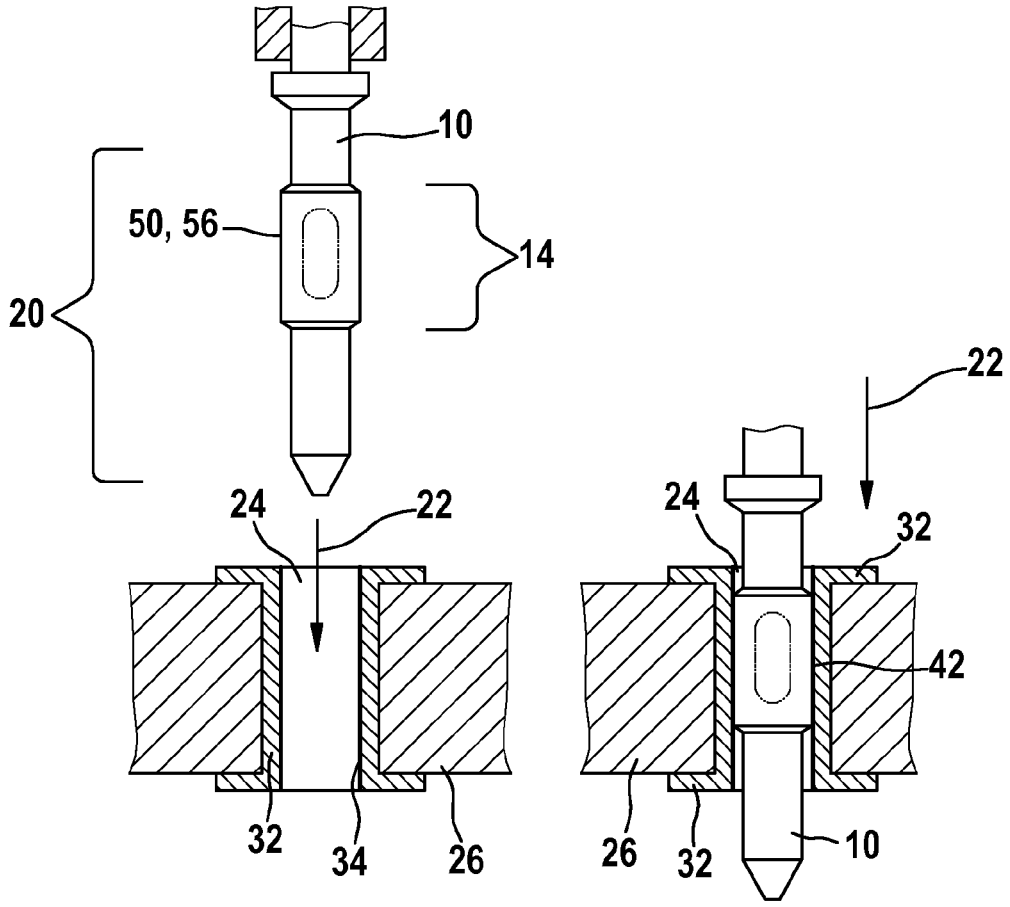
FIG. 1 is a basic illustration showing the press-fitting technique, in which a connecting pin, which comprises a press-fitting zone with an OSP coating, is pressed into a metalized opening in a printed circuit board in the press-fitting direction.

The illustration shown in FIG. 1 schematically shows the principle of the press-fitting technique for producing a solderless electrical connection 42.

As shown in FIG. 1, a connecting pin 10 is pressed into a hole 24 in a printed circuit board 26 in the press-fitting direction 22. It can be seen from the illustration shown in FIG. 1 that a press-fitting zone 14 extends above the tip of the connecting pin 10. It is also possible for an opening to be provided in the region of the press-fitting zone 14, such that the connecting pin 10 is formed by two webs extending parallel to one another within the press-fitting zone 14. The connecting pin 10 is provided with an OSP coating 56 within a coating region 20. The coating region 20 extends substantially starting above the press-fitting zone 14 to the tip of the connecting pin 10.

A solderless electrical connection 42 is produced by pressing the connecting pin 10 into the printed circuit board 26. The printed circuit board 26 has a number of openings 24, which are provided with a copper metallization 32 and with an overlying coating 34. The coating 34 serves as oxidation protection for the underlying copper metallization 32 and has a lubricating action to a greater or lesser extent depending on the material selection in the press-fitting process. Examples of possible coatings 34 are a hot tin plating or a chemically deposited metallization, e.g. nickel and gold or tin or silver, and also an organic passivation layer (OSP).

The press-fitting zone 14 of the connecting pin 10 usually consists of a copper base material and is metalized by electrodeposition. By way of metallization by electrodeposition, the press-fitting zone 14 is generally provided with a tin metallization. By applying the OSP layer 56, instead of the above-mentioned metallization, to the connecting pin 10, in particular at least along the press-fitting zone 14, as is proposed according to the invention, the risk of tin whiskers arising is minimized, or completely avoided in the case of a printed circuit board 26 which has already been provided with an OSP coating 34. It is particularly advantageous that the formation of tin chips is avoided by the OSP coating 56, as is proposed according to the invention, within the press-fitting zone 14. The OSP coating 56 in the region of the press-fitting zone 14 along the coating region 20 serves firstly as protection against oxidation which occurs and secondly as a lubricant having properties which are similar to those of a tin plating. The solution proposed according to the invention makes it possible to dispense with the application of a lubricant before a connecting pin is pressed in. Instead, the press-fitting zone 14 may already have been provided with the OSP coating 56 by the manufacturer. The solution proposed according to the invention is suitable particularly in applications in which the connecting pin 10 is provided with an electrodeposited nickel coating. In order to obtain still sufficiently low press-fitting forces and also a press-fitting connection which protects the printed circuit board 26 when a nickel coating has been electrodeposited on a connecting pin 10, a lubricant, for example silicone gel, is also applied directly before the press-fitting in a number of cases. When the solution proposed according to the invention is applied, i.e. an OSP coating 56 is applied at least in the press-fitting zone 14 of the connecting pin 10, this process step can be dispensed with when the solution proposed according to the invention is used. Before the OSP coating 56 is applied at least in the press-fitting zone 14 which lies within the coating region 20, Cu can be electrodeposited on the connecting pin 10 within this region, i.e. at least along the press-fitting zone 14, particularly preferably along the coating region 20, in order to provide exclusively Cu as a docking point for the OSP coating 56 on the surface of the connecting pin 10.

The chemical composition and the thickness of the OSP coating within the coating region 20 of the connecting pin 10 can be determined by means of an FIB (Focused Ion Beam) cut, UV spectrophotometry or an optical reflection process (OSPrey).

Figure 2:
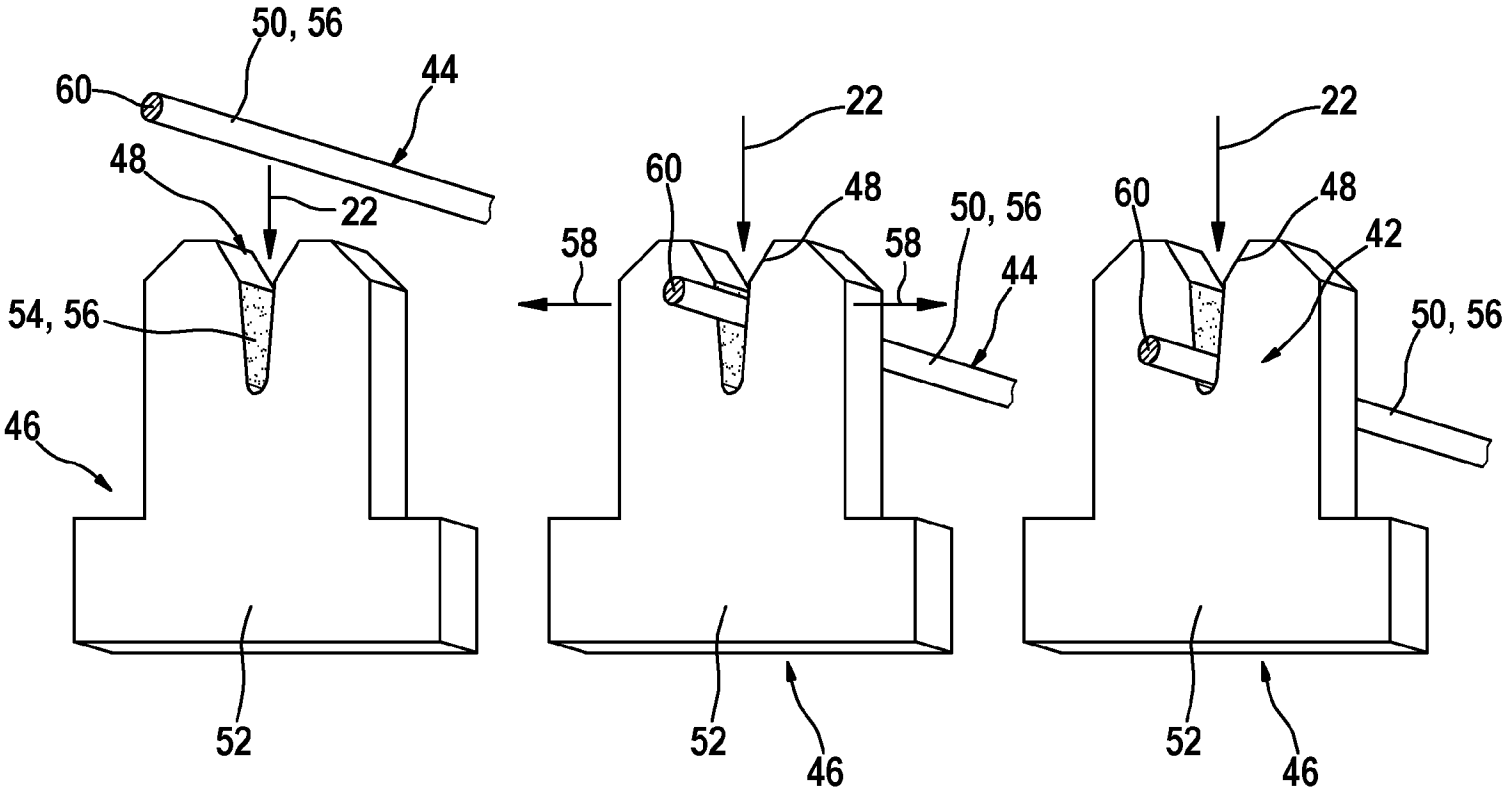
FIG. 2 is an illustration showing the principle of the insulation displacement connection, in which at least one joining partner is provided with an OSP coating.

In a further, second embodiment variant of the concept proposed according to the invention, the solderless electrical connection is in the form of an insulation displacement connection, cf. FIG. 2.

In the embodiment variant shown in FIG. 2, various stages of the production of a solderless electrical connection 42 are shown. The solderless electrical connection 42 is produced by connecting a wire 44 for connecting an electrical appliance or a lead frame to a metalized or non-metalized insulation displacement terminal 46.

The first joining partner, which is electrically connected in a solderless manner, is an insulation displacement terminal 46, which can be metalized or else non-metalized. The insulation displacement terminal 46 comprises an elastic region, which is in the form of a V-shaped notch 48 in the illustration shown in FIG. 2. The depth of the notch 48 in the material of the insulation displacement terminal 46 determines the elasticity of the material or the assembly forces which are to be applied for producing the solderless electrical connection 42.

In a first embodiment variant of the insulation displacement connection shown in FIG. 2, the contact-making surfaces of the V-shaped notch 48 in the metalized or non-metalized insulation displacement terminal 46 can be provided with the OSP coating 56.

The wire 44, as the second joining partner, is produced from copper, a copper alloy or else from steel, and comprises an oxidation-preventing layer 50. In an alternative embodiment variant of the insulation displacement connection shown in FIG. 2, the lateral surface of the wire 44 can also be provided with an OSP coating 56.

Finally, it is also possible to provide both the lateral surface of the wire 44, the base material of which can be copper, a copper alloy or steel, and the contact-making surfaces of the V-shaped notch 48 with the OSP coating 56.

In the embodiment variant of the concept on which the invention is based as shown in FIG. 2, it is possible to provide the contact-making faces for contact-connecting the first joining partner, i.e. the metalized or non-metalized insulation displacement terminal 46, with the second joining partner, i.e. the wire 44, with an electrodeposited copper coating merely in the region of the contact-making surfaces. Said electrodeposited copper undercoat serves as a docking point for the OSP coating 56.

The OSP coating 56 serves firstly as protection against oxidation and secondly as a lubricant which has properties which are similar to those of a tin plating of the contact-making surfaces on the inner side of the V-shaped notch 48 in the insulation displacement terminal 46. It is therefore no longer necessary to provide for the application of a lubricant for producing the insulation displacement connection, i.e. an entire process step is therefore dispensed with.

FIG. 2, cf. the middle illustration, also shows how the wire 44 which is inserted into the V-shaped notch 48 substantially in a vertical direction in the press-fitting direction 22 brings about a widening 58 of the metalized or non-metalized insulation displacement terminal 46 in the horizontal direction. On account of the presence of the V-shaped notch 48, the upper region of the metalized or non-metalized insulation displacement terminal 46 has an inherent appropriate elasticity, and therefore the forces which act on the solderless electrical connection 42, in particular the forces with which the wire 44 is fixed in the insulation displacement terminal 46, do not exceed a defined magnitude. Since the contact-making surfaces of the V-shaped notch 48 are provided with the OSP coating 56, which acts here as a sliding layer, "fretting" of the wire 44 is avoided when it is at first incompletely inserted into the V-shaped notch 48. In particular, a situation is avoided in which the wire 44 merges with the material of the contact-making surfaces much too early, before it reaches its end position, and therefore does not even reach its desired position, i.e. the bottom of the V-shaped notch 48 formed in the insulation displacement terminal 46.

The embodiment variant of the present invention shown in conjunction with FIG. 2 has the effect that—as can be seen in the image on the right in FIG. 2—the wire 44, as seen in the insertion direction 22, even reliably reaches its desired position on the bottom of the V-shaped notch 48. As an alternative to a separate copper undercoat on the contact-making surfaces, the insulation displacement terminal 46 can be produced from a base material 52, for example copper or a copper alloy, in the region of the V-shaped notch 48.

It is therefore possible, in the exemplary embodiment shown in FIG. 2, for an oxidation-preventing layer 50 to be applied in the form of an OSP coating 56 both to the lateral surface of the connecting wire 44 and to the contact-making surfaces of the V-shaped notch 48. Here, the OSP coating 56 additionally serves as a lubricant for reducing the assembly force and for ensuring that premature "fretting" is prevented when the first joining partner, i.e. the metalized or non-metalized insulation displacement terminal 46, is joined to the second joining partner, here the connecting wire 44.

The embodiment variant shown in FIG. 2 makes it possible to achieve production which is gentle on the material by way of insulation displacement without inadmissible damage being caused on the first joining partner or on the second joining partner or to the metallizations thereof, even without the use of Zn. The risk of tin whisker formation is thereby also avoided.

In the case of the exemplary embodiment shown in FIG. 2, it is also possible for copper to be electrodeposited or applied on the contact-making surfaces beforehand, in order to provide exclusively copper as a docking point for the OSP coating 56.

The chemical composition and the thickness of the OSP coating 56 can be determined by means of an FIB (Focused Ion Beam) cut, UV spectrophotometry or an optical reflection process (OSPrey). Use is made in particular of selectively acting Cu coordination compounds, for example phenylimidazole, benzimidazole, aminothiols, acetates, polyalcohols or diketones and further substances.

The invention claimed is:

1. A solderless electrical connection (42) comprising a first joining partner (10, 46) and a second joining partner (24, 26; 44) coupled together in a press-fit arrangement, wherein at least one of the joining partners (10, 44; 24, 26, 46) has an OSP coating (organic passivation layer) (56) on contact-making surfaces (14, 48, 54; 32, 34, 50) thereof, the contact-making surfaces (14, 48, 54; 32, 34, 50) of the first and the second joining partners (10, 44; 24, 26, 46) being in a press-fit arrangement with one another to form the electrical connection (42).

2. The solderless electrical connection (42) as claimed in claim 1, characterized in that the first joining partner is a connecting pin (10).

3. The solderless electrical connection (42) as claimed in claim 1, characterized in that the first joining partner is a metalized insulation displacement terminal.

4. The solderless electrical connection (42) as claimed in claim 1, characterized in that the first joining partner is a non-metalized insulation displacement terminal (46).

5. The solderless electrical connection (42) as claimed in claim 2, characterized in that the first joining partner (10, 46) is produced from Cu or Cu alloys and optionally has a metallization layer (54).

6. The solderless electrical connection (42) as claimed in claim 1, characterized in that the second joining partner is a coated Cu-metalized hole (34)) in a printed circuit board (26).

7. The solderless electrical connection (42) as claimed in claim 1, characterized in that the second joining partner is an uncoated Cu-metalized hole (24) in a printed circuit board (26).

8. The solderless electrical connection (42) as claimed in claim 1, characterized in that the second joining partner is a wire (44).

9. The solderless electrical connection (42) as claimed in claim 6, characterized in that the hole (24) in the printed circuit board (26) has a sleeve-like metallization (32) of Cu, which is electrodeposited and has an overlying coating (34).

10. The solderless electrical connection (42) as claimed in claim 6, characterized in that the hole (24) in the printed circuit board (26) has a sleeve-like metallization (32) of Cu, which is electrodeposited and has an overlying coating (34) of Ni, Au, Sn, Ag or an OSP coating (56).

11. The solderless electrical connection (42) as claimed in claim 2, characterized in that the OSP coating (56) of the first joining partner (10, 46) is provided with an electrodeposited copper undercoat.

12. The solderless electrical connection (42) as claimed in claim 1, characterized in that the at least one of the joining partners is provided with an electrodeposited copper undercoat on contact-making surfaces (14, 48, 54, 32, 34, 44, 50) which have been provided with the OSP coating (56).

13. The solderless electrical connection (42) as claimed in claim 12, characterized in that the first joining partner (46) has an elastic cutting zone (48) with contact-making surfaces which are provided with an electrodeposited copper undercoat.

14. The solderless electrical connection (42) as claimed in claim 12, characterized in that the first joining partner (46) has an elastic cutting zone (48), which is a V-shaped notch, with contact-making surfaces which are provided with an electrodeposited copper undercoat.

15. The solderless electrical connection (42) as claimed in claim 12, characterized in that the OSP coating (56) is an oxidation preventing layer.

16. The solderless electrical connection (42) as claimed in claim 1, characterized in that the OSP coating (56) contains at least one selectively acting Cu coordination compound.

17. The solderless electrical connection (42) as claimed in claim 16, characterized in that the selectively acting Cu coordination compound is selected from the following group: phenylimidazole, benzimidazole, aminothiols, acetates, polyalcohols and/or diketones.

18. The solderless electrical connection (42) as claimed in claim 1, characterized in that the first joining partner has an OSP coating.

19. The solderless electrical connection (42) as claimed in claim 1, characterized in that the second joining partner has an OSP coating.

20. The solderless electrical connection (42) as claimed in claim 1, characterized in that the first and second joining partners both have an OSP coating.

* * * * *